United States Patent [19]

Masica et al.

[11] Patent Number: 4,570,667

[45] Date of Patent: Feb. 18, 1986

[54] DEMAND RESPONSIVE FLOW REGULATOR VALVE

[75] Inventors: Michael T. Masica; Albert C. Wong, both of Saginaw; John F. Yonker, Frankenmuth, all of Mich.

[73] Assignee: General Motors Corporation, Detroit, Mich.

[21] Appl. No.: 651,228

[22] Filed: Sep. 17, 1984

[51] Int. Cl.[4] ..... F04B 49/08

[52] U.S. Cl. ..... 137/117; 137/500; 417/300

[58] Field of Search ..... 137/117, 500; 180/141; 417/300

[56] References Cited

U.S. PATENT DOCUMENTS

| | | | |
|---|---|---|---|
| 2,496,577 | 2/1960 | Cahill | 137/500 |
| 3,349,714 | 10/1967 | Grenier | 417/300 |
| 3,723,025 | 3/1973 | Coakley | 417/299 |
| 4,251,193 | 2/1981 | Minnis | 137/117 X |
| 4,311,161 | 1/1982 | Narumi | 137/117 |

*Primary Examiner*—Robert G. Nilson

*Attorney, Agent, or Firm*—Donald F. Scherer

[57] ABSTRACT

A demand responsive flow regulator valve for use with a power steering pump and steering mechanism has a valve spool slidably disposed in a housing and responsive to a pressure differential across an orifice for the purpose of bypassing excess pump flow. The flow control orifice establishes pressure signals proportional to pump flow to the steering mechanism. The pressure signals are operative on the valve spool to control the bypassing of excess pump flow. A spring loaded metering rod disposed in the flow control orifice increases the effective area of the orifice when pressure demand at the steering mechanism increases thereby increasing the fluid flow to the steering mechanism while simultaneously decreasing the bypass flow.

2 Claims, 1 Drawing Figure

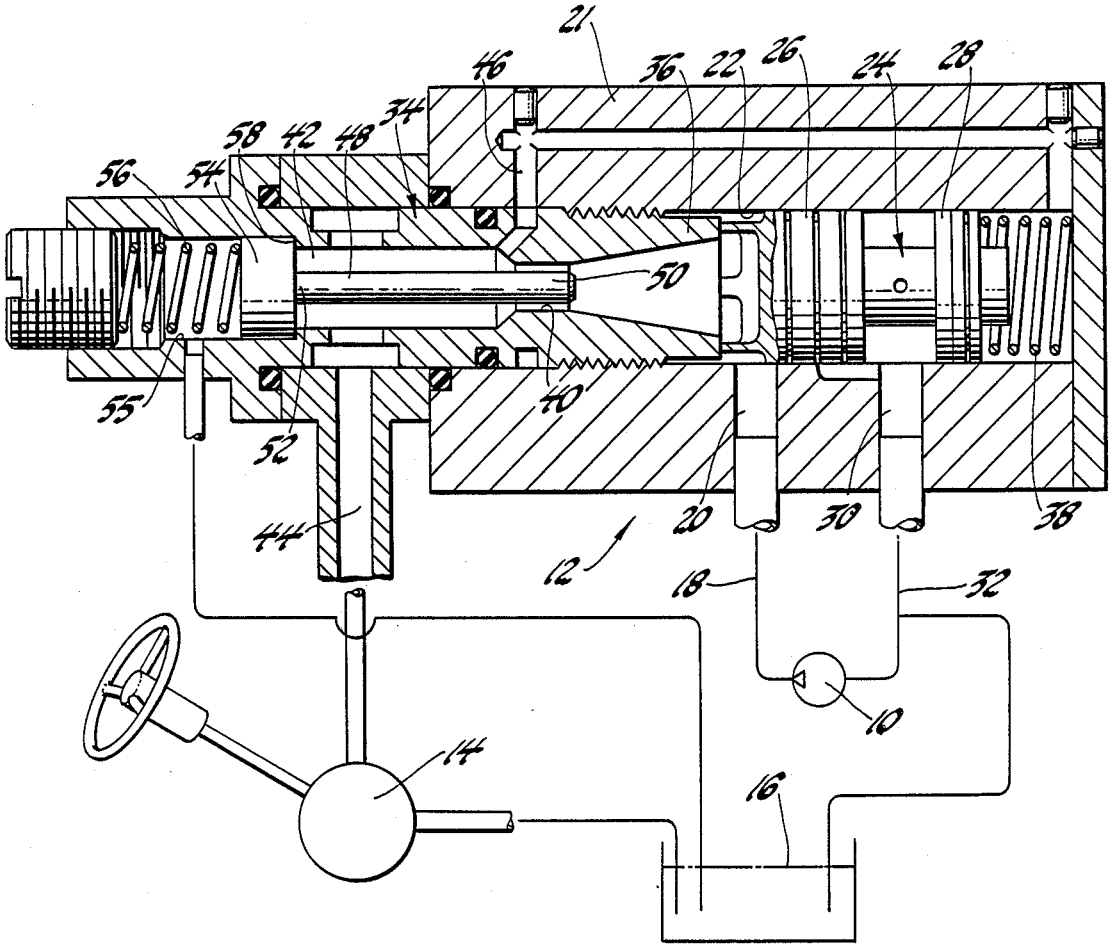
21
46
36
22
26
24
28
34
58
42
48
56
54
50
55
52
40
44
20
30
38
12
18
32
10
14
16

DEMAND RESPONSIVE FLOW REGULATOR VALVE

This invention relates to control valves and more particularly to flow control valves.

Flow control valves used with power steering systems establish the fluid flow to the power steering system by bypassing excess pump delivery. Currently flow control valves operate with an orifice which decreases in effective area size as total pump output increases. Such flow control valves provide maximum flow at low engine speeds and low vehicle speeds even when this amount of flow is not required or demanded by the power steering system.

It has been proposed to provide a flow control valve which will increase the flow to the power steering system while simultaneously decreasing bypass flow when an increase in system demand occurs. With such systems, the amount of pump delivery which is directed to the steering system will increase for a given pump speed when the pressure required to operate the system increases.

Prior art systems, such as that shown in U.S. application Ser. No. 598,481 filed Apr. 9, 1984, and assigned to the assignee of the present application, provides a differential area flow control valve which provides increased flow in response to system demand.

The present system includes an orifice or restriction with a control rod disposed therein, which rod is responsive to system pressure to increase the effective orifice or restricted area thereby causing an increase in fluid flow to the steering system as steering demand increases. The present invention uses a spool type bypass valve which is responsive to the pressure differential of the variable orifice to bypass excess pump flow.

It is therefore an object of this invention to provide an improved flow regulator valve for a power steering system wherein the valve has an orifice control member which responds to system demand to increase the effective orifice area whereby the flow regulator valve permits an increase in fluid flow to the steering system.

It is another object of this invention to provide an improved flow regulator valve for a power steering system wherein the valve has an orifice or flow restriction having a movable rod disposed therein, which rod is responsive to system pressure for changing the effective area of the orifice or flow restriction so that the regulator valve permits a system flow increase with an increase in system demand.

These and other objects and advantages of the present invention will be more apparent from the following specification and drawing which is a diagrammatic representation of a power steering system and flow control valve.

Referring to the drawing, there is seen a power steering system which includes a pump 10, a regulator valve 12, a power steering mechanism 14 and a fluid reservoir 16. The pump 10 is a conventional hydraulic pump, preferably of the vane type, and may be constructed in accordance with the pump shown in U.S. Pat. No. 3,253,548 issued to Zeigler et al. May 31, 1966. The reservoir 16 may be either integral with the pump 10 as shown in the above patent or may be separate therefrom. Both types of systems are well-known. The steering mechanism 14 may be any of the conventional steering mechanisms available such as an integral power gear, a rack and pinion system or a pressure assist system. The regulator valve 12 can be disposed in the housing of the pump 10 or in a separate housing. It is preferable to include the regulator valve in the pump housing since a more compact system with less leakage potential is provided.

The pump 10 delivers hydraulic fluid through a passage 18 to an inlet port 20 of the regulator valve 12. The regulator valve 12 includes a housing 21 in which is formed a valve bore 22 in fluid communication with the port 20 and having slidably disposed therein a valve spool 24. A valve spool 24 has a pair of lands 26 and 28. Land 26 is operable to control fluid communication between the inlet port 20 and a discharge or bypass port 30 which is in fluid communication with a passage 32 connected to the pump 10 and the reservoir 16.

The regulator valve 12 also includes an orifice assembly 34 which is threadably secured in the housing 21. The orifice assembly 34 has an extension 36 which is positioned to abut the left end of valve spool 24. The valve spool 24 is urged into said abutment by a compression spring 38.

The orifice assembly 34 has an orifice or restricted passage 40 formed therein which provides fluid communication between the inlet port 20 and a system flow passage 42. The system flow passage 42 is in fluid communication with a passage 44 connected to the steering mechanism 14 and also with a control passage 46 which is in fluid communication with the right end of valve spool 24.

The valve spool 24 is therefore subjected to a pressure upstream of orifice 40 at its left end and the pressure downstream of orifice 40 at its right end. If the pressure differential, due to fluid flow through orifice 40, is sufficient to overcome the force in spring 38, the valve spool 24 will move rightward, to a regulating position, providing controlled communication between ports 20 and 30. Thus, a portion of the pump output flow will be bypassed and the remainder will be delivered to the power steering system 14.

The orifice control assembly 34 also includes a rod member 48 which has one end 50 disposed in the orifice 40 and the other end 52 secured to a piston 54 which is slidably disposed in a bore 55. The right face of the piston 54 is subjected to the pressure downstream of orifice 40 which is substantially identical to the pressure at the power steering mechanism 14. The left face of piston 54 is abutted by a compression spring 56 which is operable to urge the rod 48 into the orifice 40. A shoulder 58 limits the rightward movement of the rod 48. During normal vehicle operation, the rod 48 will be in the position shown, and the differential pressure across orifice 40 and therefore operating on valve spoool 24 will be at a maximum such that the ratio of system flow to bypass flow will be at a minimum.

As the system pressure in steering mechanism 14 increases, that is, the system demand is increased, the pressure on piston 54 will increase. When the system pressure reaches a predetermined level, the force on piston 54 will be sufficient to overcome the force in spring 56. The piston 54 and therefore control rod 48 will move leftward. This results in end 50 moving leftward in the orifice 40 to increase the effective area of the orifice 40. As is well-known, when the orifice area increases, the pressure drop decreases for a given fluid flow through the orifice.

Since the pressure differential across the orifice decreases, the pressure differential on valve spool 24 will decrease resulting in leftward movement thereof. This valve spool movement will decrease the bypass flow while increasing the system flow thereby increasing the ratio of system flow to bypass flow. Within design limits, this ratio will continue to increase as system pressure or system demand increases until the pressure differential across orifice 40 is sufficient to cause the valve spool 24 to move to the regulating position. Therefore, during periods of high steering effort, increased system flow is present.

The valve spool 24 includes a conventional system regulator valve, the function and operation of which is well-known. Briefly, the pressure regulator valve is operable to open fluid communication between the right end of the valve spool 24 and the bypass 30 at a predetermined system pressure. Since the restriction to fluid flow through passage 46 is greater than the restriction of orifice 40, the pressure differential on valve spool 24 increases in a well-known manner to provide system pressure regulation. This type of regulator valve has been used for many years in conventional power steering systems.

The embodiments of the invention in which an exclusive property or privilege is claimed are defined as follows:

1. A flow regulator valve for use with a power steering pump and steering mechanism comprising; housing means; valve spool means slidably disposed in said housing means for bypassing excess pump flow; flow control orifice means for establishing a pressure signal proportional to pump flow to the steering mechanism, said pressure signal being operative on said valve spool means to control the bypassing of excess pump flow; and metering rod means for increasing the size of said orifice means when pressure demand at the steering mechanism increases including, rod means disposed in said orifice means, resilient means urging said rod means into said orifice means, and pressure responsive means subject to the pressure in the steering system for urging said rod means to move out of said orifice means whereby an increase in steering system pressure results in an increased fluid flow through said orifice means to said steering system, said metering rod means being mounted in said flow control orifice means for operation and movement independent of said valve spool means.

2. A flow regulator valve for use with a power steering pump and steering mechanism comprising; housing means having fluid inlet, outlet and bypass passage means; valve spool means slidably disposed in said housing means for controlling fluid flow from said inlet to said outlet and bypass for bypassing excess pump flow; flow control orifice means for establishing a pressure signal proportional to pump flow to the steering mechanism, said pressure signal being operative on said valve spool means to control the bypassing of excess pump flow; and metering rod means for increasing the size of said orifice means when pressure demand at the steering mechanism increases including, rod means disposed in said orifice means, resilient means urging said rod means into said orifice means, and piston means secured to said rod means and subjected to the pressure in the steering system, at said outlet passage means, and being movable for urging said rod means to move toward increasing the effective area of said orifice means whereby an increase in steering system pressure results in an increased fluid flow through said orifice means to said steering system.

* * * * *